US005923253A

United States Patent [19]

Anastasiou

[11] Patent Number: 5,923,253

[45] Date of Patent: Jul. 13, 1999

[54] ALERT BUTTON

[76] Inventor: Lori Susanne Anastasiou, 6242 Larchwood Dr., Huntington Beach, Calif. 92647

[21] Appl. No.: 09/089,168

[22] Filed: Jun. 2, 1998

[51] Int. Cl.[6] ..... G08B 23/00

[52] U.S. Cl. ..... 340/573.1; 340/576; 340/539; 340/693.5; 340/693.9; 128/903

[58] Field of Search ..... 340/573.1, 574, 340/539, 693.5, 693.9; 128/903

[56] References Cited

U.S. PATENT DOCUMENTS

| | | | |
|---|---|---|---|
| D. 347,397 | 5/1994 | Schauch | D10/104 |
| 4,121,160 | 10/1978 | Cataldo | 340/321 |
| 4,300,129 | 11/1981 | Cataldo | 340/539 |
| 4,587,516 | 5/1986 | Hiraki | 340/539 |
| 4,598,272 | 7/1986 | Cox | 340/539 |
| 4,694,284 | 9/1987 | Leveille et al. | 340/574 |
| 4,785,291 | 11/1988 | Hawthorne | 340/573.4 |
| 4,899,135 | 2/1990 | Ghahariiran | 340/573.4 |
| 4,908,602 | 3/1990 | Reich et al. | 340/514 |
| 5,021,794 | 6/1991 | Lawrence | 342/457 |
| 5,337,041 | 8/1994 | Friedman | 340/573.4 |
| 5,617,074 | 4/1997 | White | 340/573.4 |
| 5,619,187 | 4/1997 | Serfontein | 340/573.6 |
| 5,748,080 | 5/1998 | Clay | 340/539 |

*Primary Examiner*—Benjamin C. Lee
*Attorney, Agent, or Firm*—Goldstein & Canino

[57] ABSTRACT

An alert button, comprising a miniature housing having a sensor surface. A battery supplies power to a transmitter through a touch sensor. Upon the presence of an emergency situation, the sensor surface is touched to activate the touch sensor. The activated touch sensor then supplies power from the battery to the transmitter to produce an alert signal. The alert button comprises an attachment device for mounting the alert button onto an article of clothing or a clothing accessory.

6 Claims, 3 Drawing Sheets

ALERT BUTTON

BACKGROUND OF THE INVENTION

The invention relates to an alert button. More particularly, the invention relates to a miniature button which may be affixed to clothing and clothing accessories, and is capable of being activated by the wearer to transmit an alert signal to another location.

Great advances have taken place in the field of personal communications in recent years. Cellular telephones are now small enough to fit in the shirt pocket. Pagers are capable of receiving not only numeric messages, but also alphanumeric and voice messages. Some wristwatches now incorporate paging devices.

These devices provide great versatility in terms of the type of information that may be conveyed. They also demonstrate the extent of current miniaturization technology, wherein a complicated computerized transceiver may now be contained in a very small housing.

However, these devices fall short in terms of providing a simple alert signal in the event of an emergency. A typical cellular phone is unsuitable for providing an emergency alert.

First, even though cell phones have become quite small, they are still not so small that they can be carried everywhere. A cell phone is typically carried in a pocket, or in a purse. However, when one is not carrying a purse, or is wearing clothing without pockets, they will typically not carry a cell phone.

Second, it takes time to actually make an emergency communication using a cell phone. The phone must be switched on, several keys must be pressed to dial an emergency number, it can take several seconds for the call to connect, and then one must speak to communicate the emergency. This process can be much too time consuming in certain emergency situations.

Further, a cellular telephone is not easy to operate, especially for small children, the elderly, and people with physical or mental disabilities. All of the steps necessary to operate the phone may be well beyond one of these people. Further, it is not always desirable to give a cellular telephone to a child or a teenager, who might use the telephone indiscriminately in non-emergency situations.

Pagers are not at all suitable for communicating the presence of an emergency situation. Pagers are only capable of receiving messages—not transmitting them.

U.S. Pat. No. 4,899,135 discloses a child monitoring device, in which an alert signal is generated when a child, wearing a transmitter, strays from the parent beyond a predetermined threshold distance. U.S. Pat. No. 4,785,291 to Hawthorne also discloses a distance monitor for child surveillance.

U.S. Pat. No. 5,337,041 to Friedman discloses a personal safety guard system for a stray person or pet. The device is typically worn by a pet, and can alert the pet when their owner is looking for them. In addition, the device can emit an audible alarm signal from the pet to notify passersby that the pet is lost.

U.S. Pat. No. 5,021,794 to Lawrence, discloses a personal emergency locator system which remotely activates and "homes in" on a miniaturized transceiver which is worn upon a person, such as a lost child.

While these units may be suitable for the particular purpose employed, or for general use, they would not be as suitable for the purposes of the present invention as disclosed hereafter.

SUMMARY OF THE INVENTION

It is an object of the invention to produce an alert button which transmits a signal that indicates an emergency situation. Accordingly, a transmitter is provided which produces an alert signal when activated. The alert signal is detectable at a distinct location with a receiver.

It is another object of the invention to produce an alert button which is attached onto a wearer, and is easily concealed. Accordingly, the alert button is miniature, and has an attachment device for easy attachment onto clothing or clothing accessories.

It is another object of the invention to provide an alert button which is easily activated upon the presence of an emergency situation, so that it may be used by persons of all ages, and by people with diminished physical or mental capacity. Thus, a single touch upon the sensor surface is sufficient to activate the touch sensor, and enable the alert signal.

The invention is a alert button, comprising a miniature housing having a sensor surface. A battery supplies power to a transmitter through a touch sensor. Upon the presence of an emergency situation, the sensor surface is touched to activate the touch sensor. The activated touch sensor then supplies power from the battery to the transmitter to produce an alert signal. The alert button comprises an attachment device for mounting the alert button onto an article of clothing or a clothing accessory.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
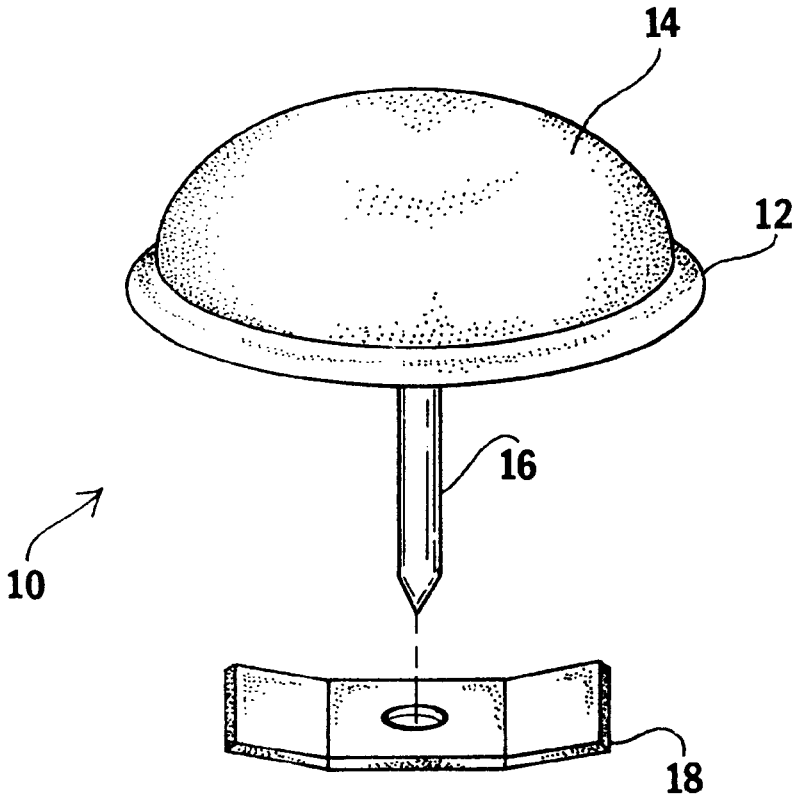
FIG. 1 is a diagrammatic perspective view, illustrating a first embodiment of the alert button, greatly enlarged for clarity.

FIG. 1 illustrates an alert button 10, comprising a housing 12 and a sensor surface 14. The housing 12 is miniature—the size of a dress shirt button, or approximately one quarter to one half inch in diameter. The alert button 10 also has an attachment device, located opposite the sensor surface 14 for attaching the alert button 10 onto a wearer.

Typically the alert button 10 is attached onto clothing or clothing accessories of the wearer. Thus, according to a first embodiment of the invention, the attachment device is a pin 16 and clip 18. The pin 16 and clip 18 interact similar to that of an earring, wherein the pin 16 is inserted through an article of clothing, and then the clip 18 attached onto the pin 16 to secure the pin 16 onto the article of clothing.

Figure 1A:
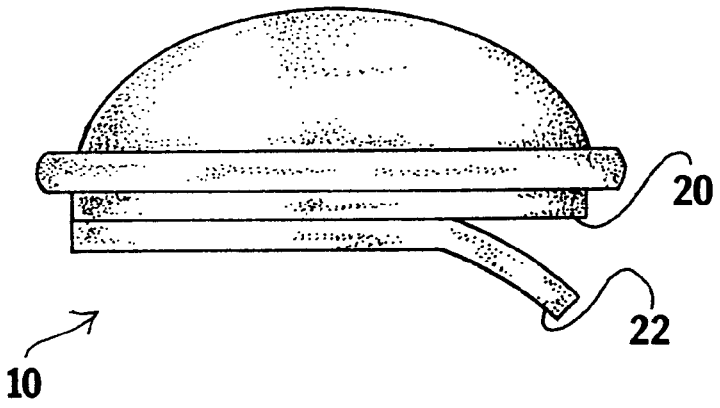
FIG. 1A is a side elevational view, illustrating a second embodiment of the alert button, greatly enlarged for clarity.

Referring to FIG. 1A, a second embodiment of the invention is illustrated, wherein the attachment device is an adhesive surface 20. The adhesive surface 20 may be selectively covered with a backing layer 22. The backing layer 22 prevents the adhesive surface 20 from inadvertently adhering to objects. The backing layer 22 is removed just prior to attaching the alert button 10 onto the wearer, and may be replaced after use to maintain the tack of the adhesive for the next use.

Figure 2:
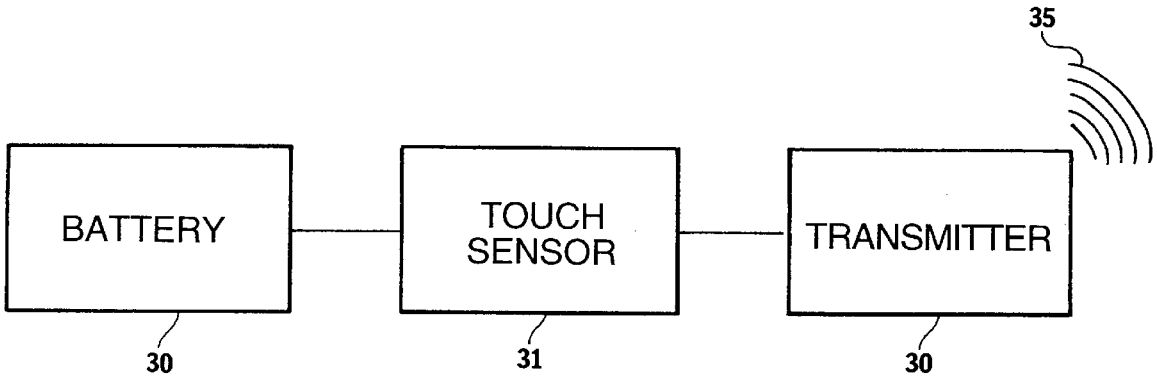
FIG. 2 is a block diagram, illustrating functional components of the alert button.

Referring to FIG. 2, a functional block diagram of the alert button 10 is indicated. The alert button comprises a battery 30, which supplies power to a transmitter 33 through a touch sensor 31. The touch sensor 31 allows power to pass from the battery 30 to the transmitter 33 when the wearer touches the sensor surface 14 seen in FIG. 1. Thus, once the touch sensor 31 is activated, the transmitter 33 is enabled to produce an alert signal 35.

Figure 3:
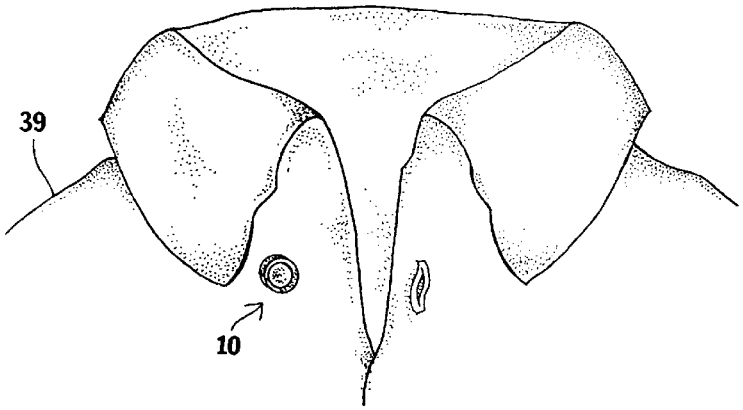
FIG. 3 is a diagrammatic perspective view, illustrating the alert button attached onto a shirt.

FIG. 3 illustrates the alert button 10, wherein said alert button 10 has been attached onto a shirt 39. The first embodiment, illustrated in FIG. 1, is most suitable for attachment onto the shirt 39. The alert button 10 may replace a common button, or may simply be extended through an open button hole, and fastened therein.

Figure 4:
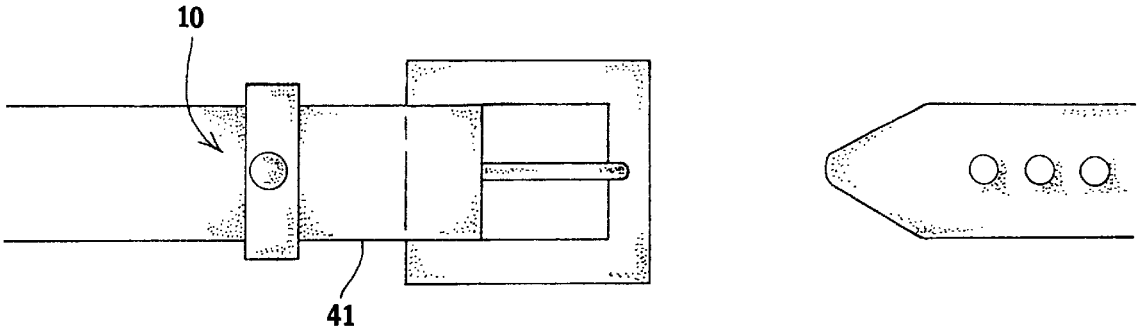
FIG. 4 is a diagrammatic perspective view, illustrating the alert button attached onto a belt.

FIG. 4 illustrates the alert button 10, wherein said alert button 10 has been attached onto a belt 41. Either the first embodiment, illustrated in FIG. 1, or the second embodiment, illustrated in FIG. 1A would be suitable for attachment onto the belt 41 as shown.

Figure 5:
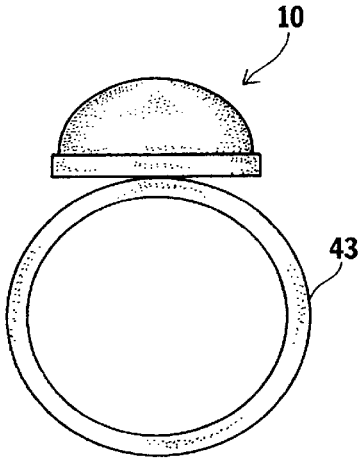
FIG. 5 is a diagrammatic perspective view, illustrating the alert button attached onto a ring.

FIG. 5 illustrates the alert button 10, wherein said alert button 10 has been attached onto a ring 43 which is worn by the wearer. The second embodiment, as illustrated in FIG. 1A is more suitable for attachment onto the ring 43 as shown.

Many other locations are suitable for attaching the alert button onto the wearer. For example, a pocket book strap, a cuff-link, a necklace pendant, a wristwatch, or the alert button may even be worn as an earring.

Once properly worn by the wearer, the alert button is inconspicuous to others, and unobtrusive to the wearer. However, when an emergency situation arises, the wearer need only touch the alert button to summon help.

Once the alert signal is transmitted, it must be received by others to be effective in summoning help. Thus, a receiver must be provided and monitored by others. The receiver produces a warning tone upon detection of the alert signal. Construction of a receiver that is suitable for detecting the alert signal and producing a warning is well known by those of ordinary skill in the art, and thus is beyond the scope of the discussion herein.

In conclusion, herein is presented an alert button which is small enough to be easily attached onto clothing or clothing accessories of a wearer. Upon the presence of an emergency situation, the alert button is activated to produce an alert signal for summoning help.

What is claimed is:

1. An alert button, for attaching onto a wearer, comprising:

a miniature housing having a sensor surface, the miniature housing attaching to the wearer;

a battery;

a transmitter within the housing for transmitting an alert signal;

a touch sensor in communication with the sensor surface, the touch sensor supplying power from the battery to the transmitter to produce the alert signal when the touch sensor is activated by touching the sensor surface.

2. The alert button as recited in claim 1, further comprising an attachment device for attaching the housing onto an item selected from clothing and clothing accessories.

3. The alert button as recited in claim 2, wherein the attachment device is fully opposite the sensor surface.

4. The alert button as recited in claim 3, wherein the attachment device comprises a pin that extends opposite the sensor surface, and a clip which is selectively fastenable onto the pin, such that the pin may be inserted through a clothing item and then the alert button be secured thereon by attaching the clip onto the pin.

5. The alert button as recited in claim 2, wherein the attachment device is an adhesive surface opposite the sensor surface.

6. The alert button as recited in claim 5, further comprising a backing layer for selectively covering the adhesive surface and preventing the alert button from inadvertently adhering to objects when not in use.

* * * * *